United States Patent [19]

Daikohara

[11] Patent Number: 4,781,538

[45] Date of Patent: Nov. 1, 1988

[54] COMPRESSOR WITH ROTATION DETECTION DEVICE

[75] Inventor: Tamotsu Daikohara, Tano, Japan

[73] Assignee: Sanden Corporation, Gunma, Japan

[21] Appl. No.: 93,216

[22] Filed: Sep. 4, 1987

[30] Foreign Application Priority Data

Sep. 4, 1986 [JP] Japan ..... 61-134892[U]

[51] Int. Cl.[4] ..... F04B 49/00

[52] U.S. Cl. ..... 417/223; 417/270

[58] Field of Search ..... 417/223, 269, 270

[56] References Cited

U.S. PATENT DOCUMENTS 4,355,959 10/1982 Kono ..... 417/223
4,594,055 6/1986 Hataheyama ..... 417/269
4,701,109 10/1987 Daikohara ..... 417/223
4,704,072 11/1987 Nakajima ..... 417/223

FOREIGN PATENT DOCUMENTS 178985 9/1985 Japan ..... 417/223

*Primary Examiner*—William L. Freeh
*Attorney, Agent, or Firm*—Banner, Birch, McKie & Beckett

[57] ABSTRACT

A rotation detecting device for a wobble plate type compressor comprises a front thrust race disposed on a flat end surface of a cam rotor and moveable therein. The front thrust race has two nail portions. A magnetic pickup is mounted on the cylindrical housing of the compressor and is positioned thereon opposite a portion of the locus of movement of the nail portions. When a nail portion passes opposite the magnetic pickup, a magnetic flux is produced. The magnetic pickup detects the magnetic flux and thus detects movement of wobble plate. Thus, the connection between the compressor and the driving source can be quickly interrupted in the event of compressor malfunction.

8 Claims, 2 Drawing Sheets

COMPRESSOR WITH ROTATION DETECTION DEVICE

TECHNICAL FIELD

The invention relates to a compressor for an automobile air conditioner including a rotation detecting device.

BACKGROUND OF THE INVENTION

When the rotation of the compressor in an automotive air conditioner is stopped by the locking of a rotation member, the connection between the driving source and the compressor should be disengaged as quickly as possible in order to prevent damage to the driving parts of the automobile. Such disengagement is desirable to ensure that the operation of other equipment remains unaffected by the compressor malfunction, especially where the compressor and other auxiliary equipment, such as an alternator or the power steering, are coupled to the engine output through a single power transmission belt.

Various rotation detecting devices have been proposed which detect compressor locks by sensing changes in the rotational speed of the compressor and then disengage the driving force to the compressor when the rotational rate falls below some predetermined reference rate. One such rotation detecting device includes a magnetic flux changing portion, which varies the magnetic flux density of a magnetic configuration in response to the rotation of a drive shaft, and a magnetic detecting device, which detects the change in flux density. The construction of these prior art devices is, however, very complicated and can also be difficult to implement. In addition, such devices have reliability problems. For example, if a magnet with a relatively large magnet flux is used as the flux changing portion, it may attract iron grains from the interior of the compressor, producing unreliable magnetic flux density values. the reliability of the detecting device may also be adversely affected by temperature changes in the interior of the compressor since some magnets are temperature sensitive and can have their magnetic properties altered if the temperature rises above, or falls below, a certain level.

SUMMARY OF THE INVENTION

It is an object of the present invention to provide an air conditioner compressor with a highly reliable rotation detecting device.

It is another object of the present invention to provide an air conditioner compressor with a rotation detecting device which is simple in construction.

The present invention is directed to an automobile air conditioner compressor including a housing, a drive shaft rotatably supported in the housing, and an electromagnetic clutch mounted on the compressor housing for selectively coupling the drive shaft to an external driving source. A cam rotor with one inclined end surface is drivingly coupled to the drive shaft. A wobble plate is disposed adjacent the inclined surface of the rotor and nutates in response to the movement of the cam rotor. The rotation detecting device comprises a front thrust race with a pair of nail portions which is disposed on the flat end surface of the cam rotor. A magnetic pickup is disposed on the housing opposite a portion of the locus of movement of the nail portions of the front thrust race. The pickup senses variations in the magnetic flux density as the nail portions pass by it.

Other objects, features and aspects of the present invention will be understood from the following detailed description of the preferred embodiment with reference to the attached drawings.

DETAILED DESCRIPTION

Figure 1:
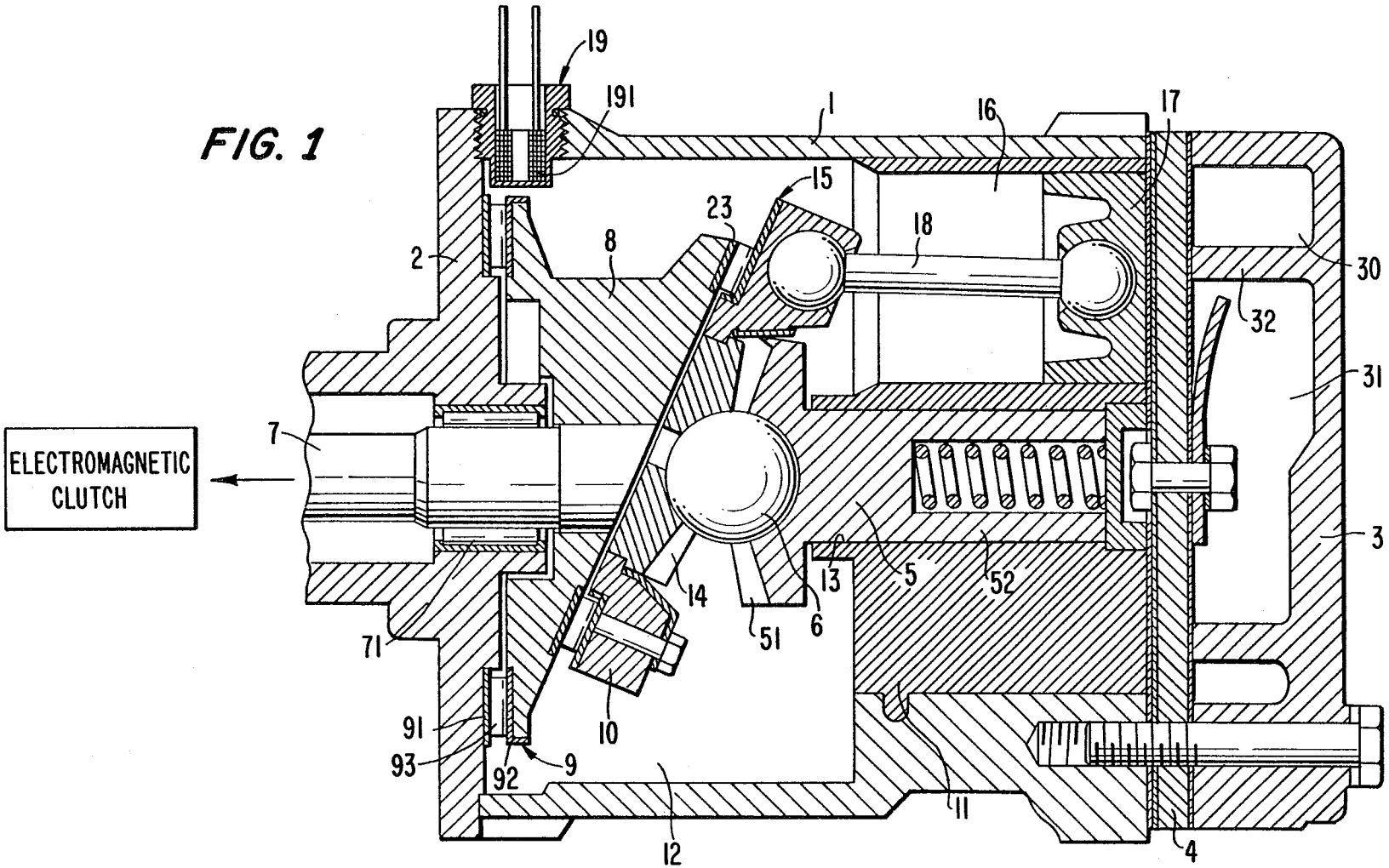
FIG. 1 is a sectional view of a wobble plate type compressor with a rotation detecting device constructed in accordance with the present invention.

Referring to FIG. 1, a wobble plate type compressor with a rotation detecting device is shown. The compressor comprises cylindrical casing 1, front housing 2 and cylinder head 3. Front housing 2 is secured to one end of cylindrical casing 1. The interior of cylindrical casing 1 defines a crank chamber 12 between cylinder block 11 and front housing 2. Cam rotor 8 is disposed within crank chamber 12 and is fixedly mounted to the inner end of drive shaft 7. Drive shaft 7 extends through a central portion of front housing 2 and is rotatably supported in front housing 2 by radial needle bearing 71. Thrust needle bearing 9 comprises needle 93 and two thrust races 91 and 92 for supporting the needle thereon. Cam rotor 8 is inclined on one end surface and is supported on the inner surface of front housing 2 by thrust needle bearing 9. Wobble plate 10 is disposed in close proximity with the inclined surface of cam rotor 8 and is supported by thrust needle bearing 15.

Figure 2:
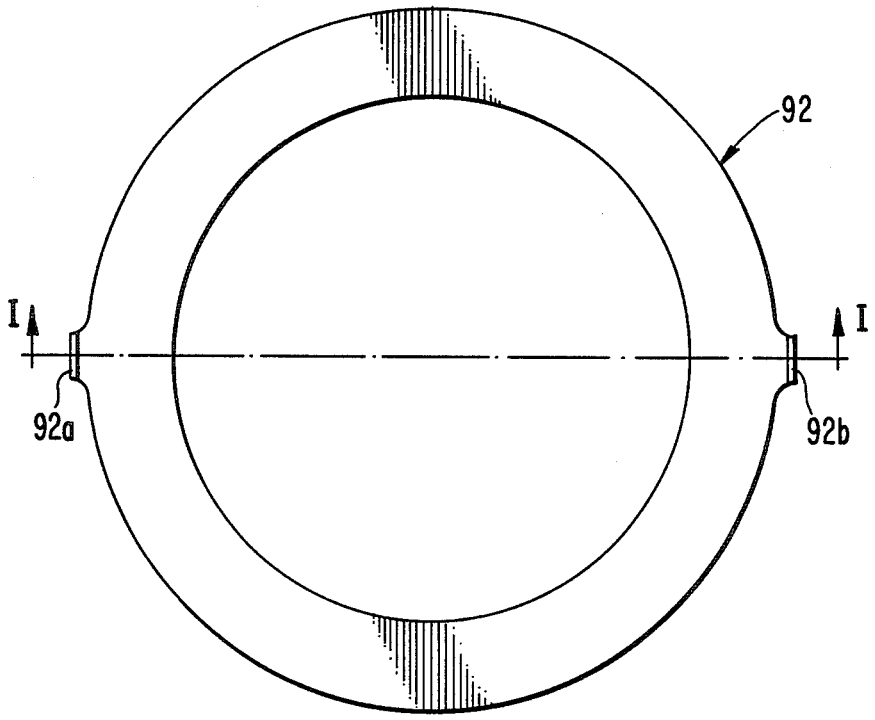
FIG. 2 is a plan view of a thrust race which is shown in FIG. 1.
Figure 3:
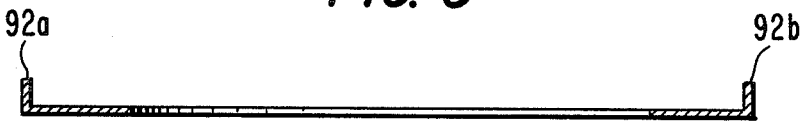
FIG. 3 is a sectional view taken along line I—I of the front thrust race shown in FIG. 2.

Referring to FIGS. 2 and 3, there is shown front thrust race 92 which has nail portions **92*a* and 92*b*. Nail portions 92*a* and 92*b* are L-shaped in section and are fitted into receiving portions on the outer peripheral surface of cam rotor 8. Rear thrust race 23 of needle bearing 15 is coupled with cam rotor 8** in such a manner as to prevent the thrust race's rotation.

Referring again to FIG. 1, a magnetic pickup 19 is disposed on cylindrical casing 1 opposite a portion of the locus of movement of nail portions **92*a* and 92*b* during the rotation of cam rotor 8**.

Cylinder block 11 is closely fitted into and secured to cylindrical casing 1. Cylinders 16 are disposed around the center axial line of cylindrical casing 1 in cylinder block 11 at equiangular intervals. Pistons 17 are slidably and closely fitted within cylinders 16. Each of the pistons 17 is coupled to wobble plate 10 through a piston rod 18. The connection of piston rod 18 with piston 17 and of piston rod 18 with wobble plate 10 is accomplished with ball joint mechanisms.

Supporting member 5 includes shank portion 52 having an axial hole at one end and a bevel gear portion 51 at its other end. Gear portion 51 has a seat for a steel ball 6 at its center. Supporting member 5 is axially and slidably (but nonrotatably) supported within cylinder block 11 by inserting shank portion 52 into center axial hole 13. The rotation of supporting member 5 is prevented by a key and key groove member (not shown).

Bevel gear portion 51 of supporting member 5 engages with bevel gear portion 14 of wobble plate 10, preventing the rotation of wobble plate 10. Steel ball 6 is positioned in the seat formed by the central portions of bevel gear portions 14 and 51 such that wobble plate 10 is nutably, but non-rotatably, supported on steel ball 6. Cylinder head 3 includes a suction chamber 30 and a discharge chamber 31 formed on the interior side thereof and defined by annular partition wall 32.

In the operation of the compressor, drive shaft 7 is driven by suitable driving means, such as automobile engine. Cam rotor 8 rotates with drive shaft 7 such that wobble plate 10 causes the reciprocating movement of respective pistons 17 within cylinders 16. This results in the compression and discharge of the refrigerant gas. In accordance with the rotation of cam rotor 8, nail portions 92*a* and 92*b* of front thrust race 92 pass pickup 19. As a result, pickup 19 detects a change of magnetic flux density two times per rotation of cam rotor 8. A failure to detect these changes of magnetic flux density is an indication of compressor malfunction and the connection between the driving source and the compressor may be quickly interrupted.

Although the invention has been described in detail in connection with the preferred embodiments thereto, it will be easily understood, by those skilled in the art, that other variations and modifications can be easily made within the scope of the invention as defined by the appended claims.

I claim:

1. In a rotation detecting device for a compressor including a housing, a drive shaft rotatably supported in said housing, a cam rotor drivingly coupled to said drive shaft and a wobble plate disposed adjacent a first surface of said cam rotor and nutating in response to the movement of said cam rotor, an improvement comprising:

a thrust race disposed on a second surface of said cam rotor and coupled thereto by a plurality of projections; and detecting means disposed on said housing for detecting the magnetic flux density at a successive passes of said plurality of projections during rotation of the cam rotor.

2. The improved rotation detecting device according to claim 1 wherein said plurality of projections comprises two projections.

3. The improved rotation detecting device according to claim 1 wherein said detecting means disposed on said housing for detecting the magnetic flux density comprises a magnetic pickup positioned opposite a portion of the locus of movement of said plurality of projections.

4. The improved rotation detecting device according to claim 3 wherein said plurality of projections comprises two projections.

5. In a rotation detecting device for a refrigerating compressor including a housing, a drive shaft rotatably supported in said housing, an electromagnetic clutch mounted on said compressor housing for selectively coupling said drive shaft to an external driving source, a cam rotor drivingly coupled to said drive shaft, and a wobble plate disposed adjacent a first, inclined surface of said cam rotor and nutating in response to the movement of said cam rotor, the improvement comprising:

a front thrust race disposed on a second surface of said cam rotor and coupled thereto by a plurality of projections; and detecting means disposed on said housing for detecting the magnetic flux density at successive passes of said plurality of projections during rotation of the cam rotor.

6. The improved rotation detecting device according to claim 5 wherein said plurality of projections comprises two projections.

7. The improved rotation detecting device according to claim 5 wherein said detecting means disposed on said housing for detecting the magnetic flux density comprises a magnetic pickup positioned opposite a portion of the locus of movement of said plurality of projections.

8. The improved rotation detecting device according to claim 7 wherein said plurality of projections comprises two projections.

* * * * *